US007231820B2

(12) United States Patent
Kinsey et al.

(10) Patent No.: US 7,231,820 B2
(45) Date of Patent: Jun. 19, 2007

(54) TEST STAND FOR HYDRAULIC OSCILLATOR USING GAS-FILLED SHOCK ABSORBERS

(75) Inventors: Eric Kinsey, Dover, OH (US); James C. Raies, Canton, OH (US); David Schumacher, Navarre, OH (US)

(73) Assignee: Dover Hydraulics, Inc., Dover, OH (US)

( * ) Notice: Subject to any disclaimer, the term of this patent is extended or adjusted under 35 U.S.C. 154(b) by 158 days.

(21) Appl. No.: 10/948,851

(22) Filed: Sep. 24, 2004

(65) Prior Publication Data

US 2005/0066752 A1 Mar. 31, 2005

Related U.S. Application Data

(60) Provisional application No. 60/506,460, filed on Sep. 26, 2003.

(51) Int. Cl.
*G01M 19/00* (2006.01)

(52) U.S. Cl. ..... 73/168

(58) Field of Classification Search ..... 73/168
See application file for complete search history.

(56) References Cited

U.S. PATENT DOCUMENTS 1,907,835 A * 5/1933 Langbein ..... 73/132
4,176,549 A 12/1979 Eichinger
4,480,464 A 11/1984 Whisenand et al.
4,702,105 A * 10/1987 Raymont, Jr. ..... 73/168
4,727,924 A 3/1988 Dobinski et al.
4,798,086 A * 1/1989 Styfhoorn ..... 73/168
5,096,168 A * 3/1992 Takehara et al. ..... 267/220
5,572,440 A * 11/1996 Harashima et al. ..... 700/280
6,205,853 B1 * 3/2001 Dei et al. ..... 73/168
6,575,037 B2 6/2003 Momoi et al.

* cited by examiner

*Primary Examiner*—Robert Raevis
(74) *Attorney, Agent, or Firm*—Sand & Sebolt

(57) ABSTRACT

A test stand and related method for testing a hydraulic oscillator cylinder having an oscillating drive includes gas-filled shock absorbers for reacting oscillating movement of the oscillating drive to simulate operational load conditions of the oscillator cylinder. The shock absorbers are mounted on a rigid structure and preferably abut an oscillating member mountable on the oscillating drive to react the oscillating movement thereof. The oscillating member may be disposed between a pair of rigid members on which the shock absorbers are mounted whereby one set of shock absorbers reacts movement of the oscillating member in one direction and another set reacts movement of the oscillating member in the opposite direction. Translating structure may extend between the oscillating member and oscillating drive and through a hole in one of the rigid members. Guide shafts may guide oscillating movement of the oscillating member. Gas pressure within the shock absorbers may be controlled.

34 Claims, 12 Drawing Sheets

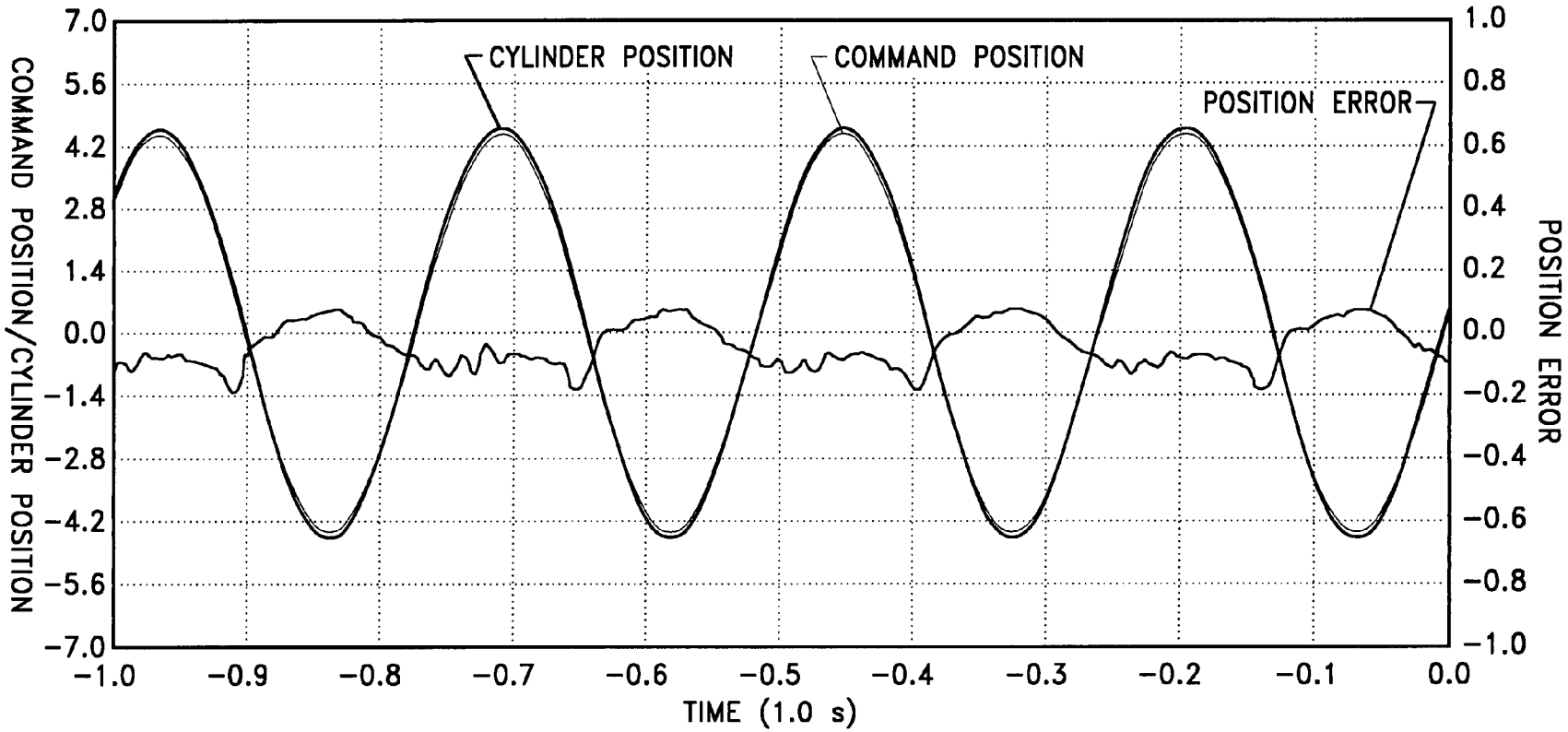
FIG−13

TEST STAND FOR HYDRAULIC OSCILLATOR USING GAS-FILLED SHOCK ABSORBERS

CROSS REFERENCE TO RELATED APPLICATIONS

This application claims priority from U.S. Provisional Patent Application Ser. 60/506,460 filed Sep. 26, 2003; the disclosure of which is incorporated herein by reference.

BACKGROUND OF THE INVENTION

1. Technical Field

The invention relates to a test stand for hydraulic oscillator cylinders. More particularly, the invention relates to a test stand having spring-like mechanisms to counter the oscillating movement of the hydraulic oscillator cylinder to simulate operational load conditions of the oscillator cylinder. Specifically, the invention relates to a test stand in which the spring-like members are gas-filled shock absorbers.

2. Background Information

Oscillators are used in a variety of fields. Hydraulic oscillators are much less common. One of the applications for hydraulic oscillators relates to the continuous casting of metal. Such hydraulically powered oscillators typically vibrate several times per second. Because hydraulic oscillator cylinders play a key role in the continuous casting business, it is important to ensure that they are fully functional prior to installing them to prevent undue downtime for failed oscillator cylinders. Due to the relatively large weight under which these oscillators sometimes labor, it has been necessary in certain cases to use excessively large coil springs in order to duplicate the actual working conditions of the oscillators. Such large coil springs are expensive and cumbersome, requiring a test stand of substantial size in order to accommodate them. In addition, the use of coil springs in test stands for the hydraulic oscillator cylinders leaves room for improvement in terms of the accuracy of the readings gained from the test stand. These problems are addressed by the test stand of the present invention.

BRIEF SUMMARY OF THE INVENTION

The present invention provides a method for testing an oscillator cylinder having an oscillating drive, the method comprising the steps of oscillating the oscillating drive; reacting movement of the oscillating drive with at least one gas-filled shock absorber; and assessing the functionality of the oscillator.

The present invention also provides a test stand for testing an oscillator cylinder having an oscillating drive, the test stand comprising at least one gas-filled shock absorber adapted to react movement of the oscillating drive; and an oscillator cylinder functionality assessment mechanism.

The present invention further provides a test stand for testing an oscillator cylinder having an oscillating drive, the test stand comprising a rigid frame including a base and first and second spaced projections mounted on the base; the first and second projections having respective substantially flat surfaces which are substantially parallel to one another and face one another; an oscillating member having a pair of opposed sides which are substantially flat and substantially parallel to one another and the substantially flat surfaces of the first and second projections; the oscillating member being oscillatably mounted on the frame between the flat surfaces of the first and second projections and adapted for mounting on the oscillating drive; a plurality of first gas-filled shock absorbers mounted on the first projection for reacting movement of the oscillating member in a first direction; a plurality of second gas-filled shock absorbers mounted on the second projection for reacting movement of the oscillating member in a second direction opposite to the first direction; a plurality of guide members extending between the first and second projections for guiding movement of the oscillating member; and an oscillator cylinder functionality assessment mechanism.

BRIEF DESCRIPTION OF THE SEVERAL VIEWS OF THE DRAWINGS

FIG. 13 is a graph showing the comparison of the command position and the actual position of the oscillating drive of an oscillator cylinder tested by the test stand of the present invention.

Similar numbers refer to similar parts throughout the specification.

DETAILED DESCRIPTION OF THE INVENTION

The test stand of the present invention is indicated generally at 10 and is shown particularly in FIGS. 1–5. Test stand 10 uses gas-filled shock absorbers 84 and 86 in the testing of a hydraulic oscillator cylinder 12.

Figure 1:
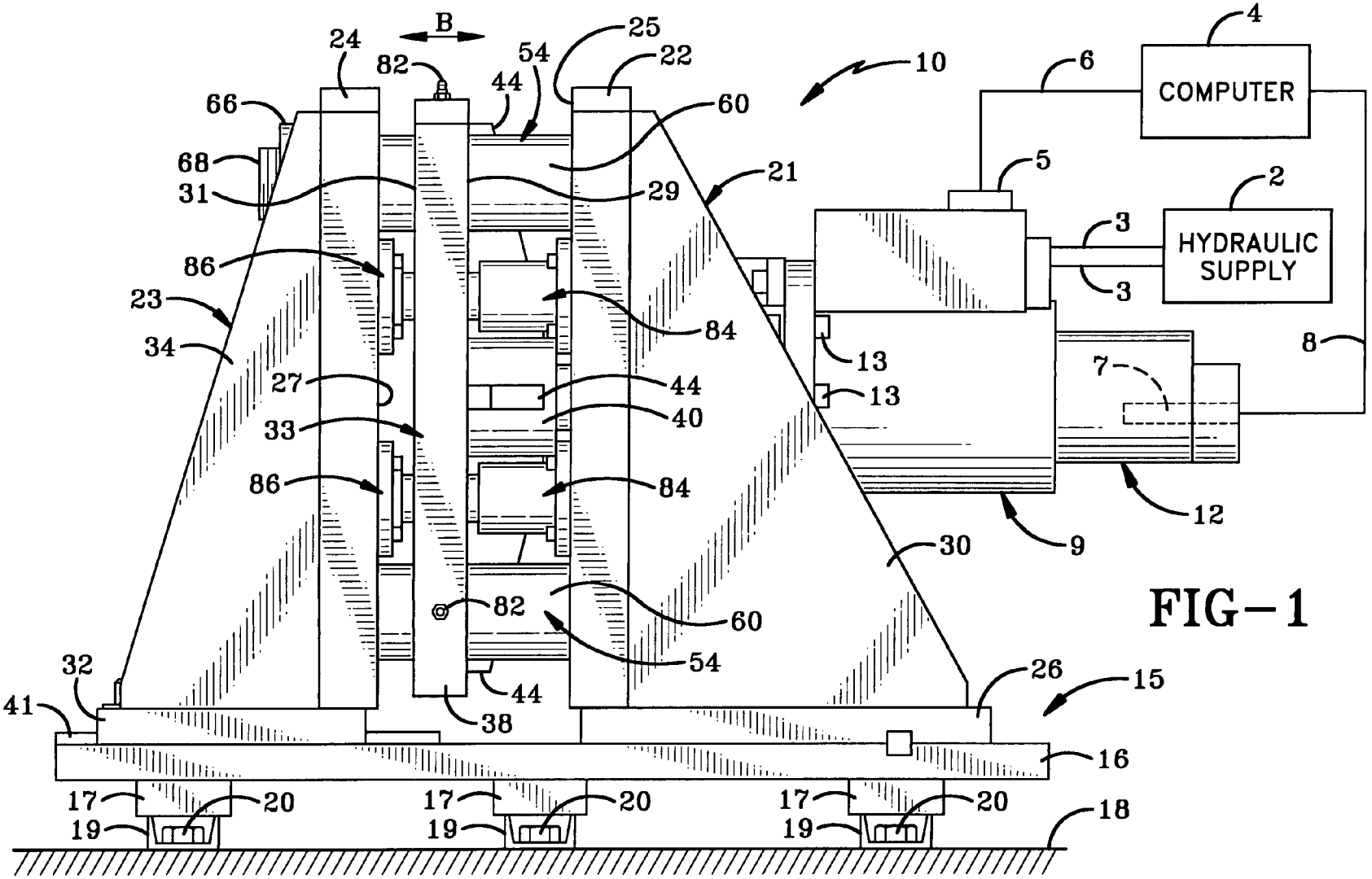
FIG. 1 is a side elevational view of the test stand of the present invention with a hydraulic oscillator cylinder attached thereto.
Figure 2:
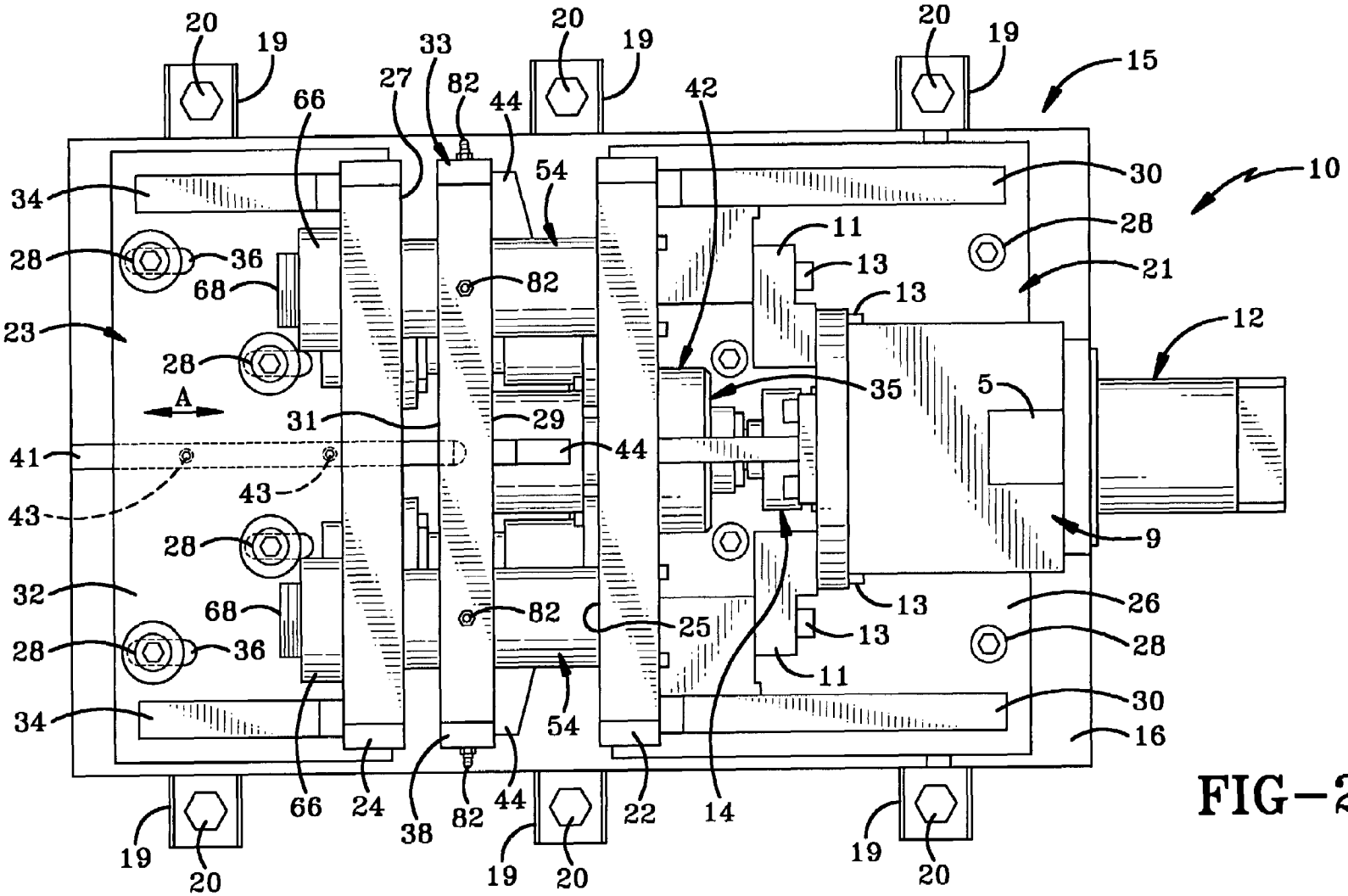
FIG. 2 is a top plan view of the test stand and oscillator cylinder.
Figure 3:
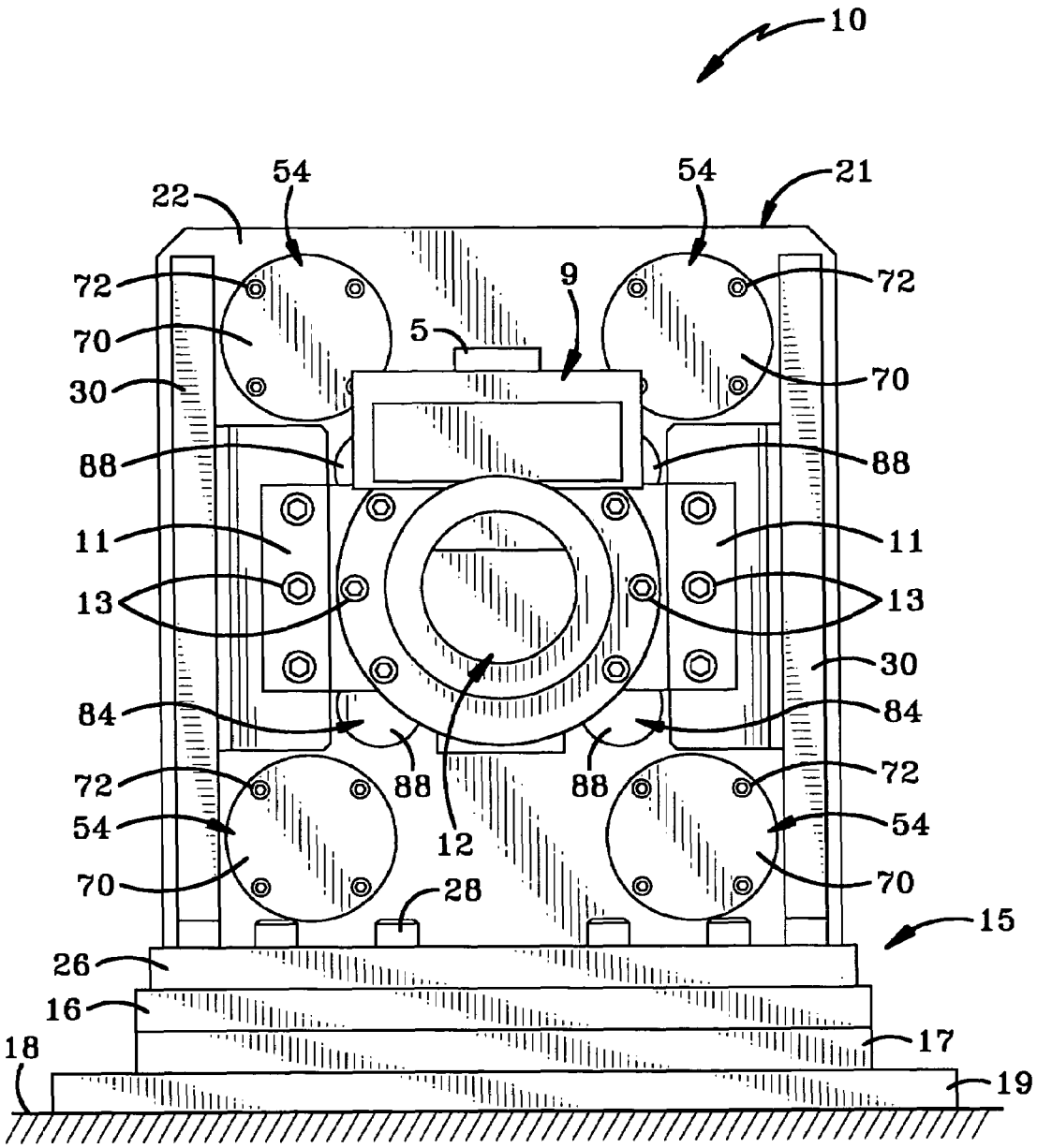
FIG. 3 is a front end elevational view of the test stand with the oscillator cylinder attached thereto.
Figure 3A:
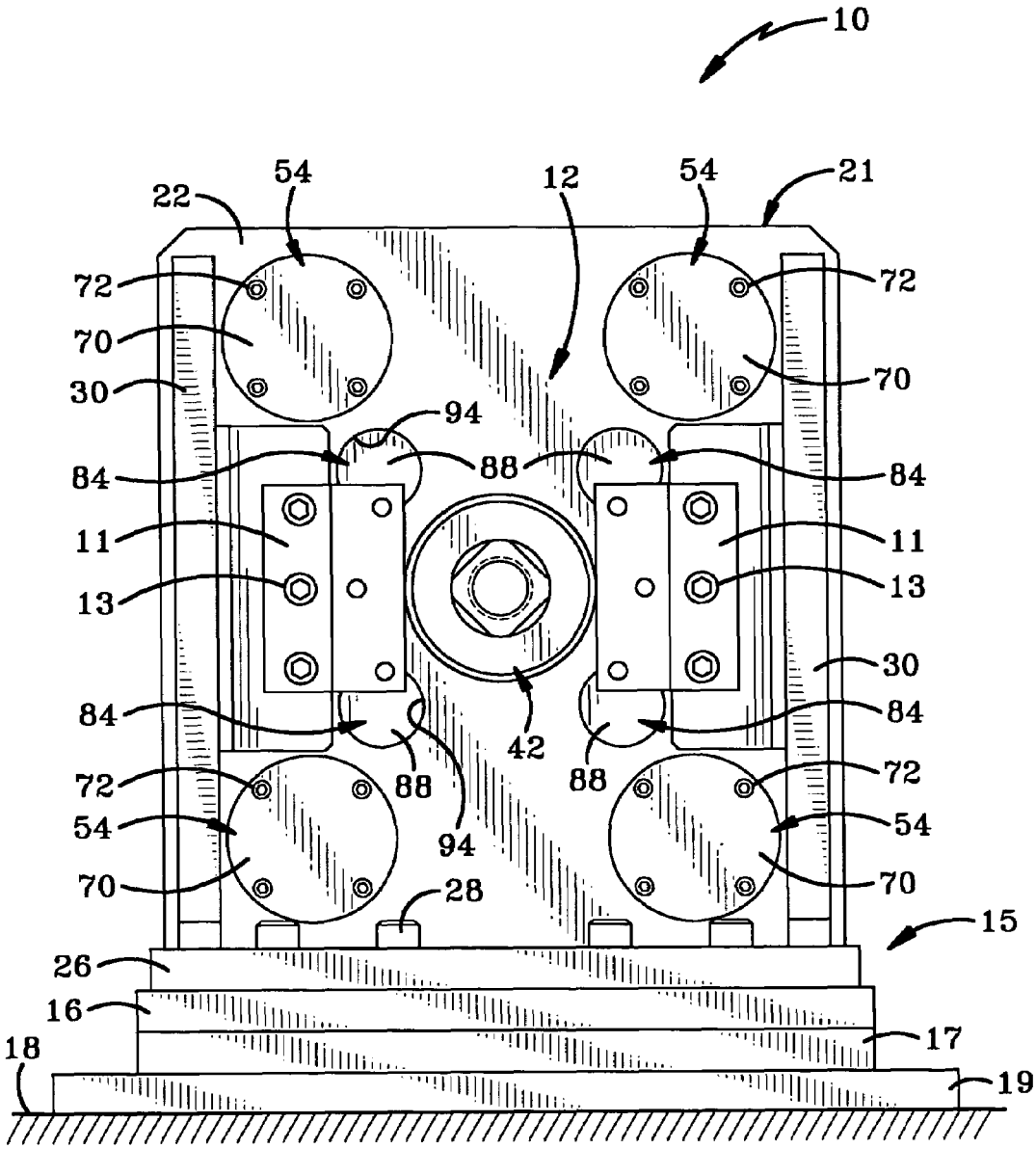
FIG. 3A is a front end elevational view of the test stand with the oscillator cylinder removed.
Figure 5:
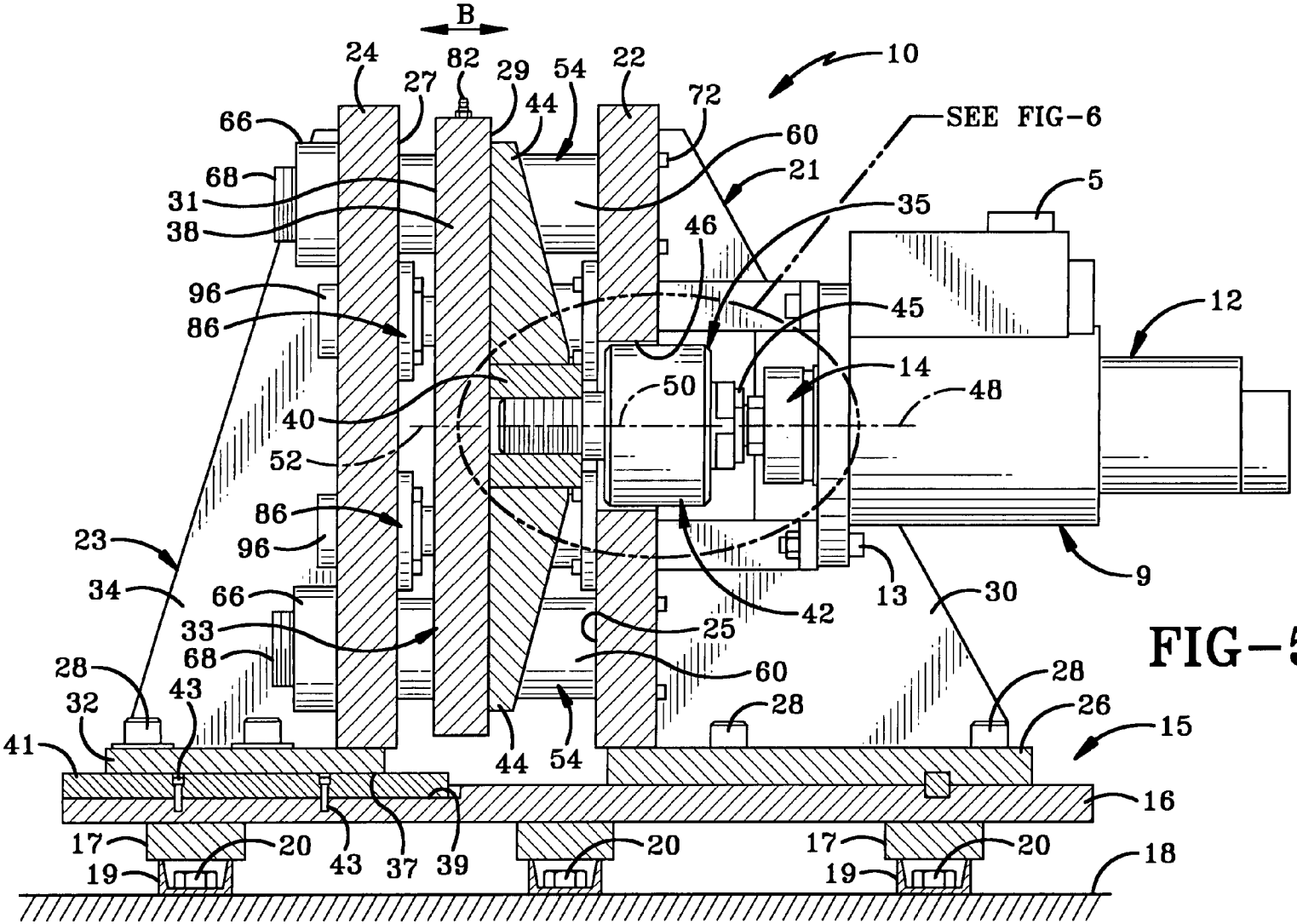
FIG. 5 is a sectional view taken on line 5—5 of FIG. 4.
Figure 6:
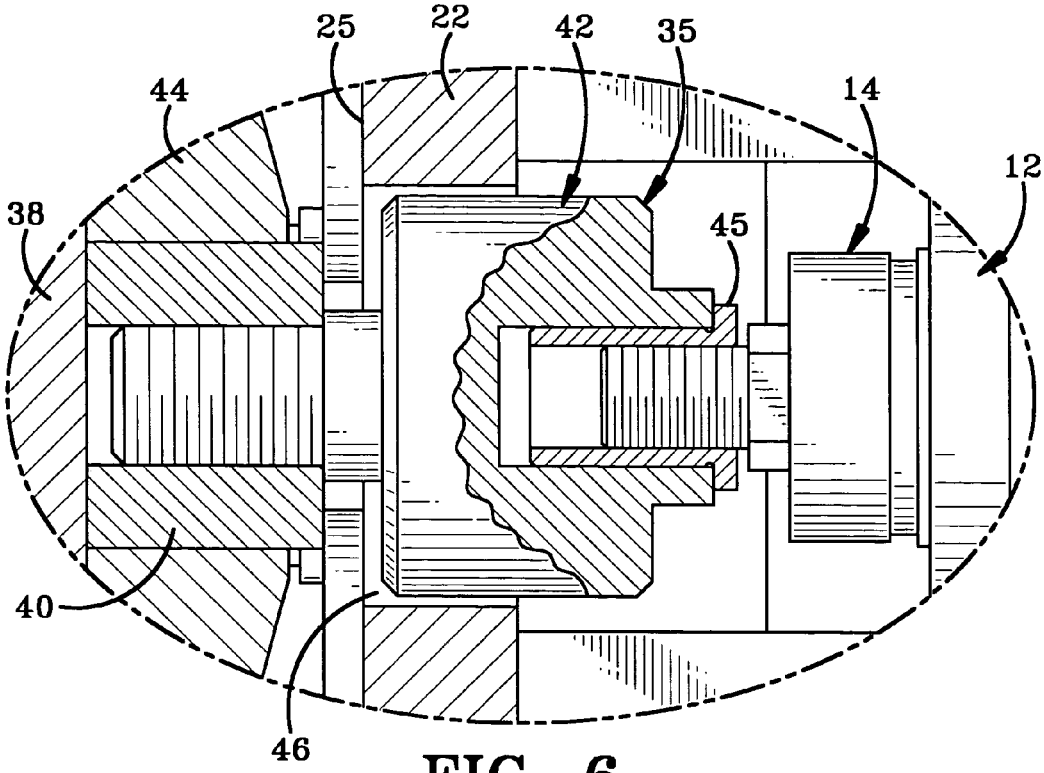
FIG. 6 is an enlarged view of the encircled portion of FIG. 5 with portions cut away.

FIGS. 1 and 2 show test stand 10 with hydraulic oscillator cylinder 12 mounted thereon via mounts 11 and bolts 13 (FIGS. 3, 3A, 5). As seen in FIGS. 1, 2 and 6, hydraulic oscillator cylinder 12 includes a body 9 and an oscillating drive 14 which moves in and out with respect to body 9 in the direction indicated by Arrow B (FIG. 1). A hydraulic power supply 2 is in communication with oscillator cylinder 12 via hydraulic lines 3 for conveying hydraulic fluid.

Test stand 10 is used to assess the functionality of oscillator cylinder 12, to include assessing the accuracy of stroke length and oscillation rate of oscillating drive 14 (FIG. 2) and whether cylinder 12 has leaks, in particular whether there is leakage or bypass of hydraulic fluid around the piston (not shown) of oscillating drive 14 within oscillator cylinder 12. Preferably, test stand 10 is used with a computer 4 so that very accurate measurements can be made as oscillator cylinder 12 is being tested on test stand 10. Computer 4 is in electrical communication with a servo valve 5 via a command line 6 and with a position sensor 7 via feedback line 8. Servo valve 5 may be any suitable valve for controlling movement of oscillating drive 14.

Test stand 10 includes a rigid structure in the form of a frame 15, which includes a base 16, a first rigid member or projection 21 and a second rigid member or projection 23. First projection 21 includes a first plate 22, a foot 26, and a pair of spaced supports 30. Second projection 23 includes a second plate 24, a foot 32, and a pair of spaced supports 34. First projection 21 and second projection 23 extend upwardly from base 16 and are spaced from one another. Base 16 sits atop three elongated legs 17 which sit atop elongated feet 19. Base 16 is mounted to a floor 18 or other stationary structure, as by bolts 20 or other suitable fasteners.

First plate 22 and second plate 24 extend upwardly from base 16 and are situated in opposed relationship to one another. In the exemplary embodiment, plates 22 and 24 are substantially parallel to one another. More particularly, plate 22 has a substantially flat surface 25 and plate 24 has a substantially flat surface 27 which faces surface 25 and is substantially parallel thereto. Plate 22 sits atop foot 26 which is rigidly mounted to base 16, as by bolts 28 (FIG. 2) or other suitable fasteners known in the art. Spaced supports 30 angle upwardly from foot 26 to first plate 22 in order to add rigidity to first plate 22 with respect to foot 26 and base 16. Likewise, second plate 24 rests atop foot 32 rigidly mounted on base 16 as by bolts 28 or other suitable fasteners. Spaced supports 34 angle upwardly from foot 32 to second plate 24 to add rigidity to plate 24 with respect to foot 32 and base 16.

In the exemplary embodiment, foot 32 defines elongated holes or slots 36 which removably receive bolts 28 in order to allow adjustment of projection 23 with respect to base 16 in the direction of arrow A, as shown in FIG. 2. The adjusting movement of second projection 23 along the direction indicated by arrow A is guided by the combination of a first elongated channel 37 (FIG. 4) formed in the bottom of foot 32, a second elongated channel 39 formed in the top of base 16 and aligned with first channel 37, and an elongated key 41 disposed partially within each of channels 37 and 39. Key 41 is mounted to base 16 by fasteners 43 (FIG. 2).

Test stand 10 further includes an oscillating member 33 including a plate 38, a mounting cylinder 40 extending outwardly therefrom and mounted rigidly thereto and four strengthening ribs 44 extending between plate 38 and mounting cylinder 40. Ribs 44 extend perpendicularly with regard to one another and are rigidly mounted to plate 38 and cylinder 40 to provide additional stability to plate 38. Plate 38 is substantially parallel to plates 22 and 24. More particularly, plate 22 has a first substantially flat surface 29 which faces surface 25 of first plate 22 and a second substantially flat surface 31 which faces surface 27 of second plate 24. Surfaces 29 and 31 of movable plate 38 are substantially parallel to one another and to surfaces 25 and 27 of respective plates 22 and 24. Oscillating member 33 is movable back and forth in the direction of arrow B (FIG. 1).

As shown in FIG. 5, translating structure 35 is removably mounted on each of oscillating drive 14 and oscillating member 33. More particularly, translating structure 35 includes a coupler 42 removably mounted on mounting cylinder 40 and an adapter 45 removably mounted on coupler 42. More particularly, mounting cylinder 40 is internally threaded to receive a threaded portion of a coupler 42 (FIGS. 5, 6, 11, 12), which is adapted to removably couple with oscillating drive 14 of hydraulic oscillator cylinder 12 via adapter 45. Coupler 42 and adapter 45 thus provide a removable connector between oscillating drive 14 and oscillating member 33 so that if the connection between coupler 42 and adapter 45 or the connection between adapter 45 and oscillating drive 14 becomes worn, coupler 42 and/or adapter 45 can be replaced relatively inexpensively as opposed to the replacement of oscillating member 33 if oscillating member 33 were directly connected to oscillating drive 14.

Figure 11:
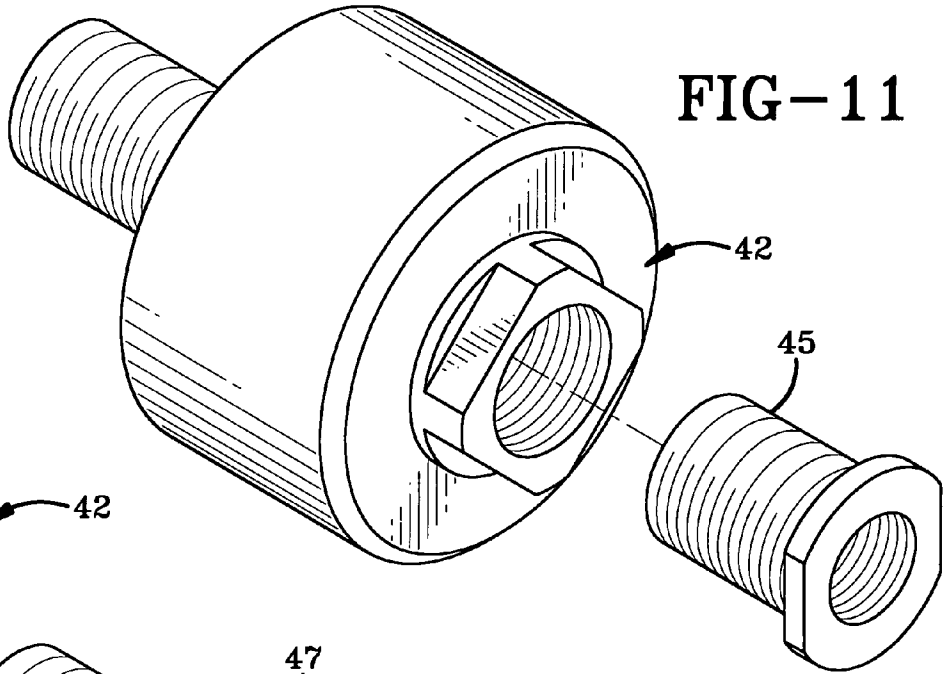
FIG. 11 is an enlarged perspective view of the coupler and adapter shown in FIG. 6.
Figure 12:
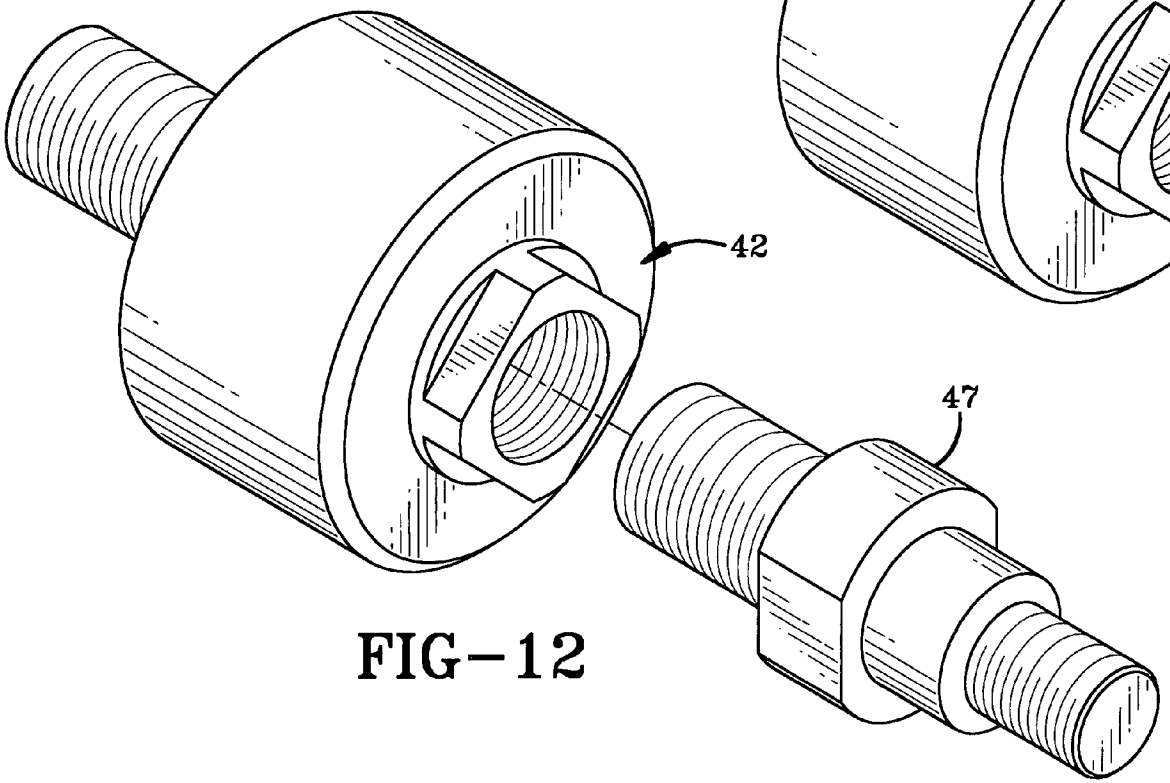
FIG. 12 is an enlarged perspective view of the coupler shown in FIG. 6 with an alternate adapter.

Coupler 42 is shown in FIG. 11 along with adapter 45 and in FIG. 12 with an alternate adapter 47, each being threadably receivable within an internally threaded portion of coupler 42. Once connected to coupler 42, adapter 45 constitutes a female portion for receiving a male portion of oscillating drive 14 of hydraulic oscillator cylinder 12. Alternately, adapter 47 is configured to be a male portion to couple with a female portion of an alternate oscillating drive. Thus, adapters 45 and 47 can accommodate either a male or female oscillating drive 14.

First plate 22 defines a central hole 46, as seen in FIG. 5, for receiving a portion of coupler 42 so as to allow a portion of coupler 42 to extend through first plate 22 and threadably engage cylinder 40 as previously noted, thus allowing translation of oscillating movement of oscillating drive 14 via translating structure 35 in order to oscillate movable plate 38 in the direction of arrow B. Referring to FIG. 5, oscillating drive 14 has a central axis 48 which is coaxial with a central axis 50 of coupler 42 and also coaxial with a central axis 52 of movable plate 38. Thus, oscillating drive 14, translating structure 35 and oscillating member 33 each have central axes which are coaxial.

Four guide members in the form of guide shafts 54 extend between first plate 22 and second plate 24 and extend through respective holes 56 formed in first plate 22 and holes 58 (FIG. 10) formed in second plate 24. Guide shafts 54 are preferably spaced evenly about axis 52 and preferably are equidistant from axis 52. Guide shafts 54 are mounted on first plate 22 and second plate 24 and serve as spacing members so that the spacing between first plate 22 and second plate 24 is not altered by the mounting of shafts 54 thereon, and more particularly so that first plate 22 and second plate 24 are not pulled toward one another by guide shafts 54. The manner in which guide shafts 54 are mounted allows for this.

Figure 9:
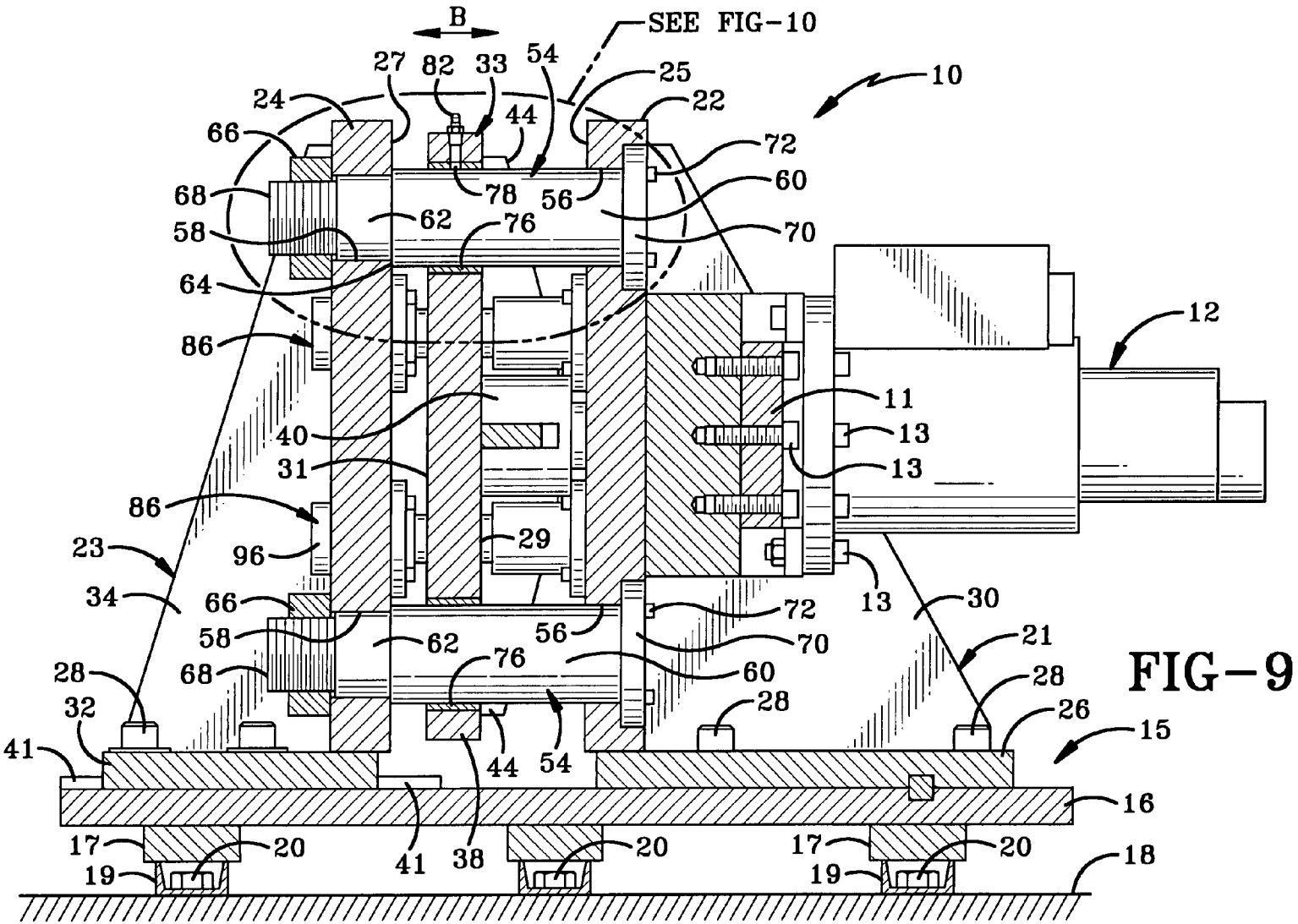
FIG. 9 is a sectional view taken on line 9—9 of FIG. 4.
Figure 10:
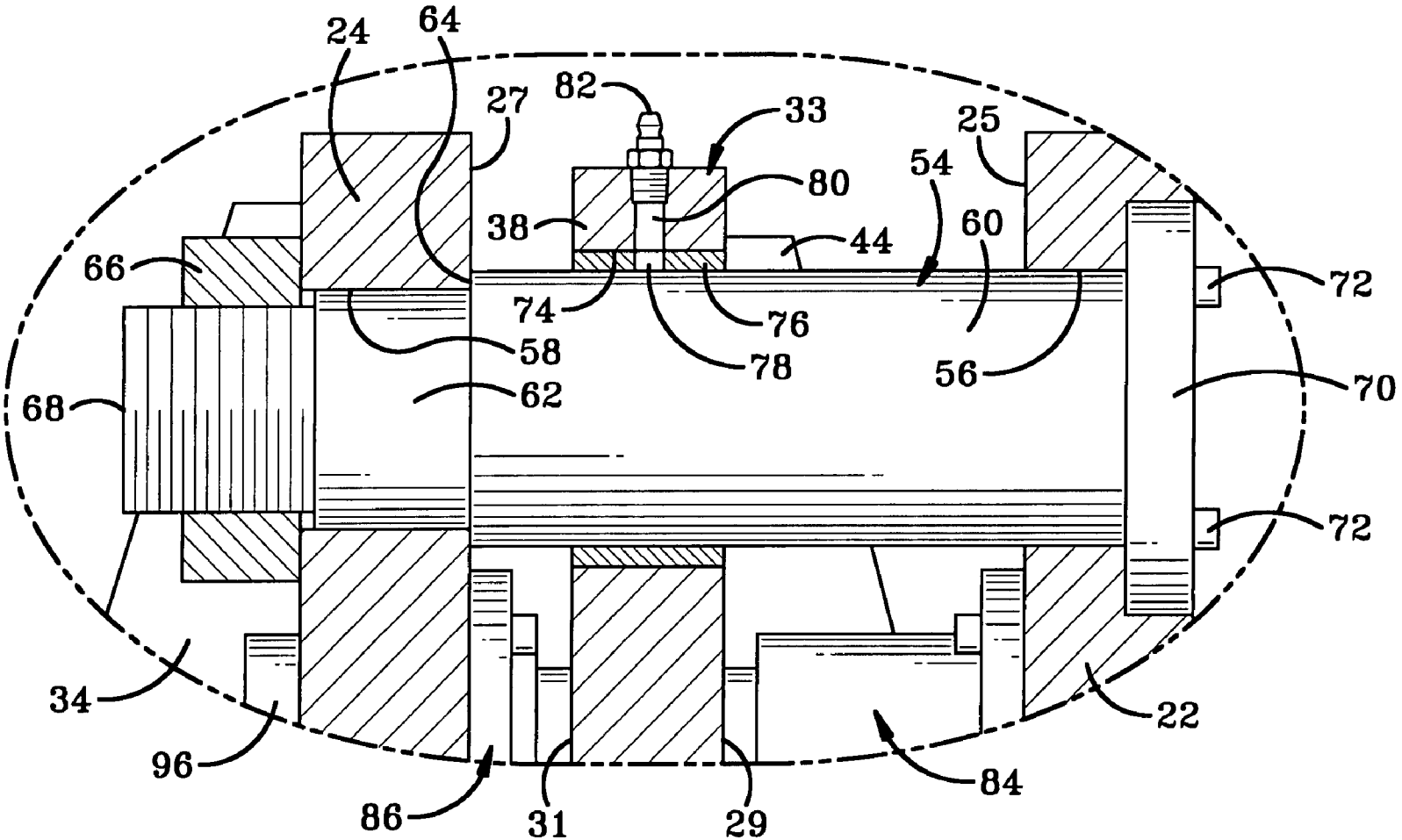
FIG. 10 is an enlarged view of the encircled portion of FIG. 9.

Specifically and with reference to FIGS. 9 and 10, each guide shaft 54 includes an enlarged section 60 which steps down to a reduced diameter section 62 to form a shoulder 64 therebetween. Section 62 is disposed in one of holes 58. Shoulder 64 abuts one side of second plate 24 so that when a threaded ring 66 threadably engages a threaded portion 68 of guide shaft 54, second plate 24 is clamped between threaded ring 66 and shoulder 64. Guide shaft 54 further includes an enlarged head 70 which is seated in a counterbore portion of hole 56 formed in first plate 22. Mounting bolts 72 extend through holes (not shown) in head 70 of guide shaft 54 to mount guide shaft 54 to first plate 22. Guide shafts 54 further extend through respective holes 74 formed in movable plate 38. Within each hole 74 is mounted a bushing 76 through which a respective guide shaft 54 extends, each bushing 76 being slidably movable along the length of guide shaft 54. Each bushing 76 defines a lubricating hole 78 in communication with a lubricating hole 80 formed in movable plate 38, with a lubricating receptacle 82 threadably received in hole 80. The number of guide shafts may vary, although four works well in balancing the need to smoothly guide the oscillating movement of plate 38 with desire to minimize frictional engagement between guide shafts 54 and bushings 76.

Figure 8:
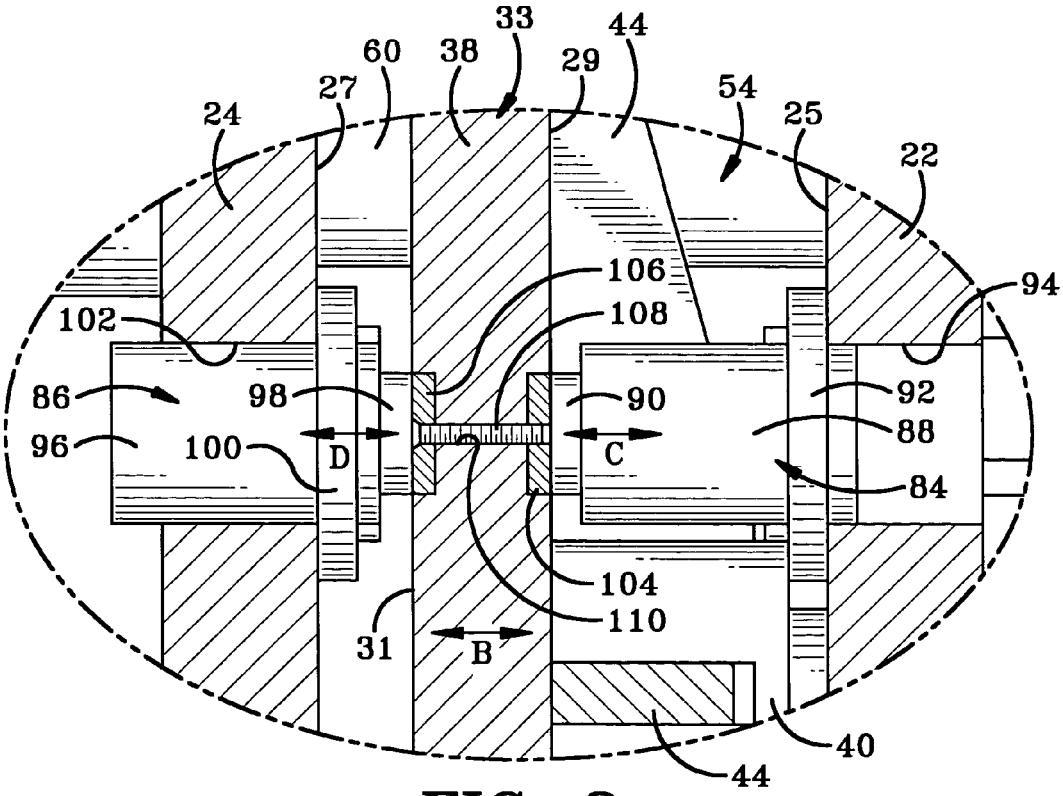
FIG. 8 is an enlarged sectional view of the encircled portion of FIG. 7.
Figure 7:
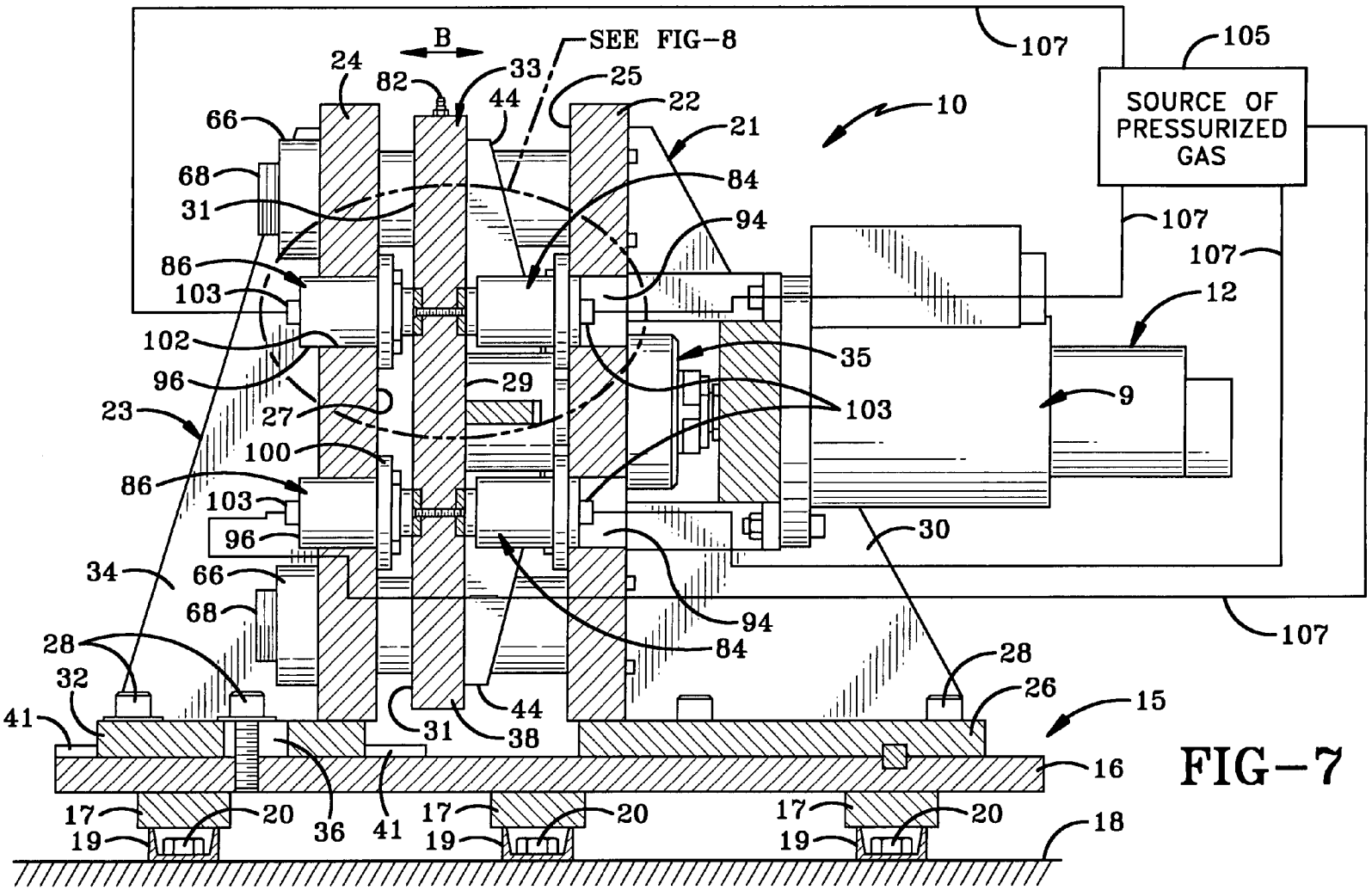
FIG. 7 is a sectional view taken on the line 7—7 of FIG. 4.

In accordance with one of the main features of the present invention and with reference to FIGS. 7 and 8, a first set of first gas-filled shock absorbers 84 is mounted on first plate 22 between first plate 22 and movable plate 38 and a second set of second gas-filled shock absorbers 86 is mounted on second plate 24 between second plate 24 and movable plate 38 so that each first shock absorber 84 is aligned with a second shock absorber 86 to form a corresponding pair of shock absorbers in opposed relation to one another on opposite sides of movable plate 38. Each first shock absorber includes a cylinder 88 and a piston 90 slidably received therein, piston 90 being movable in a direction indicated by arrow C. Each first shock absorber 84 further includes a mounting ring 92 for mounting shock absorber 84 on first plate 22. Cylinders 88 are partially received and respective holes 94 formed in first plate 22.

Similarly, each second gas-filled shock absorber 86 includes a cylinder 96 and a piston 98 slidably received therein and slidable along a direction of arrow D. Each second shock absorber 86 also includes a mounting ring 100 for mounting cylinder 86 on second plate 24. Cylinders 96 are received within respective holes 102 formed in second plate 24, each cylinder 96 extending all the way through second plate 24. As seen in the figures, cylinder 88 of first shock absorber 84 extends outwardly further from first plate 22 toward movable plate 38 than does cylinder 96 from second plate 24. This additional extension of cylinder 88 is to accommodate the size of mounting cylinder 40 and ribs 42 extending between movable 38 and first plate 22.

Each of shock absorbers 84 and 86 contain a gas, preferably nitrogen, although any suitable gas may be used. Suitable nitrogen-filled shock absorbers are available from Associated Spring Raymond of Maumee, Ohio. The gas in each shock absorber 84 and 86 is most typically pressurized. A pressure-charging or pressure-adjusting valve 103 is associated with each shock absorber 84 and 86 and is used to selectively permit gas to move into or out of each shock absorber 84 or 86 in order to control pressure within each shock absorber. Each shock absorber is in fluid communication with a source 105 of pressurized gas via a respective valve 103 and a respective conduit 107.

Figure 4:
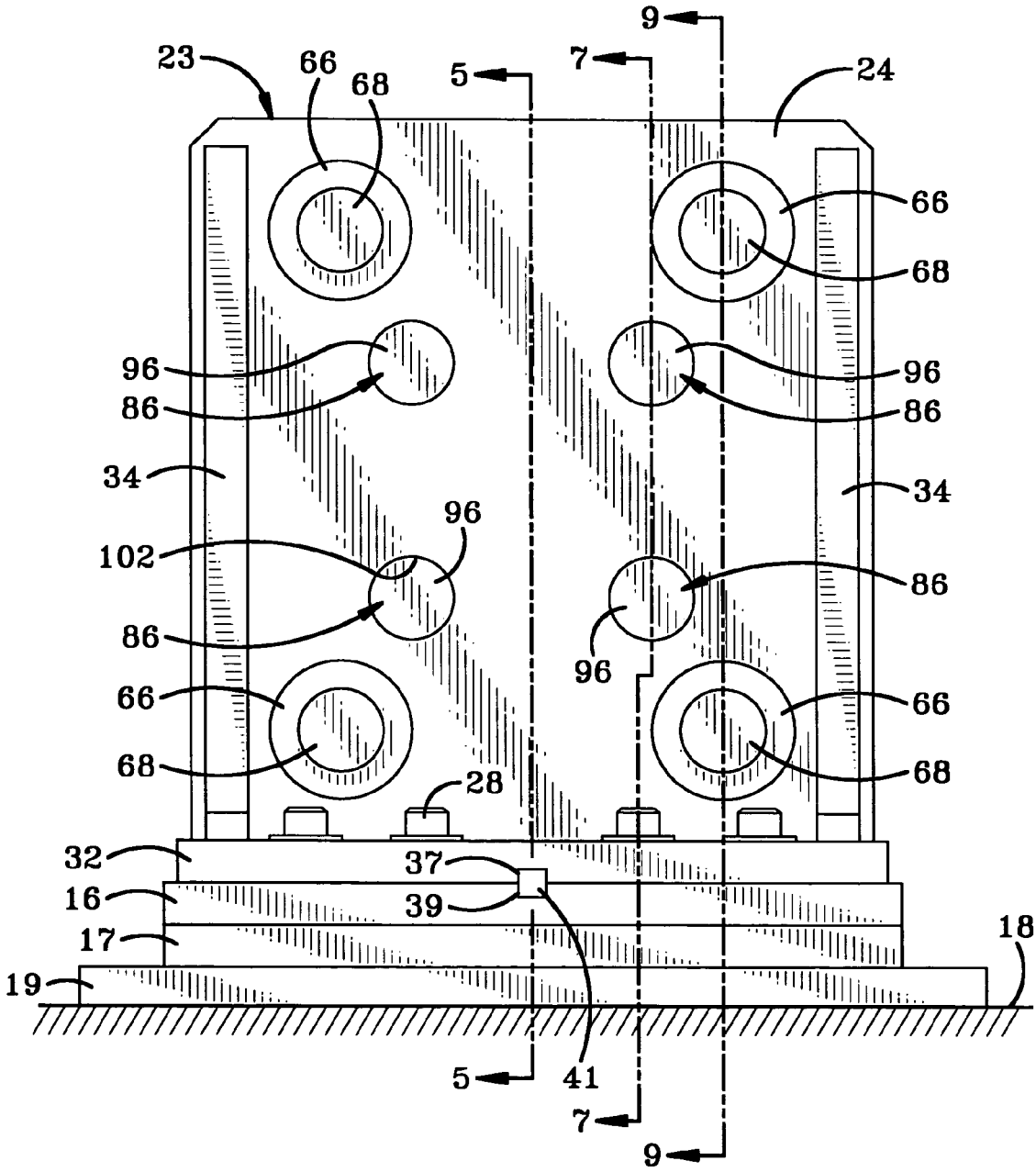
FIG. 4 is a rear end elevational view of the test stand.

To prevent undue friction or seizure of movable plate 38 on guide shafts 54 and to prevent undue misalignment of oscillating member 14 with respect to oscillator cylinder 12, shock absorbers 84 and 86 are preferably spaced evenly about central axis 52 of movable plate 38 and are most preferably equidistant from central axis 52 and movable plate 38 (FIGS. 3–4).

In accordance with a feature of the invention, a pressure control mechanism permits gas pressure within each shock absorber 84 and 86 to be adjusted. In particular, a base line gas pressure may be set as desired in accordance with varying operational conditions. The term "base line gas pressure" is herein used to indicate the pressure of gas within one of shock absorbers 84 or 86 when at rest at a standard position, preferably with the piston in a fully extended position, and at a given standard temperature. Thus, regardless of various factors which affect pressure, the base line gas pressure may remain the same. For instance, the base line gas pressure is the same within a given shock absorber 84 or 86 although during operation of test stand 10, the oscillation of pistons 98 causes continual alteration of the gas pressure within each shock absorber 84 and 86, alternately increasing and decreasing respectively during compression and decompression of the gas therein.

The base line gas pressure within each cylinder 88 of each first shock absorber 84 is most preferably substantially equal to the base line gas pressure in the other cylinders 88 of first shock absorbers 84. Likewise, the base line gas pressure within each cylinder 96 of each second shock absorber 86 is most preferably substantially the same in order to maintain a proper alignment of movable plate 38. Another preferable arrangement is to ensure a substantially equal base line gas pressure within each pair of first shock absorbers 84 which are opposed to one another with respect to central axes 48, 50, 52. This arrangement helps prevent movable plate 38 from becoming tilted with respect to axes 48, 50, 52 and similarly applies to analogous pairs of second shock absorbers 86.

The pressure control mechanism includes a variety of options for controlling base line gas pressure in shock absorbers 84 and 86. Controlling the base line gas pressure may involve maintaining it, increasing it or decreasing it. Each valve 103 may be opened to release gas from a respective shock absorber 84 or 86 to decrease the base line gas pressure. To increase the base line gas pressure, valves are opened to allow pressurized gas from source 105 to add gas to respective shock absorbers 84 or 86. With this ability to increase and decrease gas pressure, the base line gas pressure may be maintained or altered as desired.

A plurality of hardened members in the form of hardened plates (FIG. 8) are mounted on movable plate 38. These hardened plates include first hardened plates 104 mounted on one side of plate 38 and second hardened plates 106 mounted on the other side of movable plate 38 in opposed relation to first hardened plates 104 to form a pair of aligned hardened plates, each pair being joined by a threaded fastener 108 extending through a hole 110 formed in and extending through movable plate 38. Each first hardened plate 104 is aligned with and abuts a piston 90 of a respective first shock absorber 84. Likewise, each second hardened plate 106 is aligned with and abuts a respective piston 98 of a second shock absorber 86.

Hardened plates 104 and 106 are used to reduce or eliminate the gradual damage that would ordinarily be inflicted upon movable plate 38 by pistons 90 and 98 during operation of test stand 10. Hardened plates 104 and 106 can easily be removed and replaced if they are damaged, thereby providing an inexpensive method of maintaining the integrity of movable plate 38 without having to replace movable plate 38. Hardened plates 104 and 106 may be mounted in an alternate fashion, such as being threadedly connected to movable plate 38 via a threaded hole formed in plate 38, for example. However, the connection of plate 104 to plate 106 severely reduces or eliminates any damage to movable plate 38 which may result from such an alternate connection and thus extends the life of movable plate 38.

In operation, test stand 10 functions as follows. A hydraulic oscillator cylinder 12 to be tested is mounted on test stand 10 so that oscillating drive 14 is coupled with coupler 42 via one of adapters 45 and 47 whereby oscillating member 33 is connected to oscillating drive 14 via translating structure 35 (FIGS. 2, 5, 7, 9). Oscillator cylinder 12 is then operated so that oscillating drive 14 oscillates back and forth to drive coupler 42 and movable plate 38 to likewise oscillate along the direction of axes 48, 50 and 52, as indicated by arrow B (FIGS. 1, 2, 5, 7–9). Preferably, computer 4 controls operation of cylinder 12, as detailed further below.

With reference to FIGS. 9 and 10, proper alignment and smooth movement of movable plate 38 is assisted by the slidable engagement between guide shafts 54 and respective bushings 76 as movable plate 38 moves back and forth in the direction of arrow B. As movable plate 38 oscillates back and forth in the direction indicated by arrow B, pistons 90 and 98 move in accordance therewith, as indicated by arrows C and D respectively in FIG. 8. The movement of pistons 90 and 98 is caused by the oscillating movement of movable plate 38 through the contact of first hardened plate 104 with piston 90 and second hardened plate 106 with piston 98.

In accordance with one of the main features of the invention, shock absorbers 84 and 86 absorb the impact of and react the movement of oscillating drive 14 as translated through coupler 42, movable plate 38 and respective pistons 90 and 98. The gas inside of cylinders 88 and 96 is pressurized as desired to simulate the conditions under which hydraulic oscillator cylinder 12 will function in actual use. Thus, second shock absorbers 86 create a force in opposition to movement of oscillating drive 14, translating structure 35 and oscillating member 33 as drive 14 extends in a first direction along axes 48, 50, 52 away from body 9 of oscillator cylinder 12 to simulate operational conditions of the oscillator cylinder. Similarly, first shock absorbers 84 create a force in opposition to movement of oscillating drive 14, translating structure 35 and oscillating member 33 as drive 14 retracts in a second direction along axes 48, 50, 52 opposite the first direction toward body 9 of oscillator cylinder 12 to simulate operational conditions of the oscillator cylinder.

One advantage gained from shock absorbers 84 and 86 is the smooth operation of test stand 10. Another advantage of using gas-filled shock absorbers 84 and 86 is that the gas pressure therein can be varied to test for different operational conditions without having to remove shock absorbers 84 and 86 and replace them with different ones. This is not possible with a typical coil spring or other type of spring mechanisms. Thus, hydraulic oscillator cylinder 12 can, for instance, be tested under gradually increasing pressures. Thus, it is a simple matter to test one hydraulic oscillator cylinder at lower pressures and build up to a given maximum pressure for that particular oscillator cylinder, while a different oscillator cylinder may be tested for differing pressures, for instance, a higher maximum range. In addition, especially in contrast to large coil springs or the like needed to simulate fairly substantial forces (like those found in continuous casting), gas-filled shock absorbers are far more compact, more readily available and less costly.

Another advantage of this system is that the pressures within cylinders 88 and 96 can be varied during operation of test stand 10 and hydraulic oscillator cylinder 12, thus eliminating the need to stop the testing process in order to adjust the pressures or to remove one set of shock absorbers and install another set with different pressures, as noted above. The change in pressures can be accomplished by providing pressurized gas from source 105 through respective pressure-adjusting valves 103 into cylinders 88 and 96.

Another advantage of this configuration is that the gas pressure within first cylinders 88 can be adjusted to differ from the gas pressure within second cylinders 96, thus imitating different operational parameters of hydraulic oscillator cylinder 12, whereby the force exerted against the stroke of oscillating drive 14 in one direction differs from the force operating against the stroke of oscillator drive 14 in the opposite direction. To simulate the various forces exerted on oscillating drive 14 which are found in operational conditions, several options are available. As previously noted, pressure within cylinders 88 and/or 96 may be altered to vary said force. Additionally, the number of cylinders 88 and/or 96 may be increased or decreased to alter said force. In addition, cylinders 88 and/or 96 may be replaced with other such cylinders which have greater or less pressure capacity to alter said force. As noted previously, shock absorbers 84 and 86 are preferably evenly distributed about central axis 52 of movable plate 38 to prevent misalignment of movable plate 38, coupler 42, and oscillating drive 14 so as to prevent undue friction and wear and tear on both test stand 10 and oscillator cylinder 12.

Oscillator cylinder 12 can be operated to control the stroke length of oscillating drive 14 as well as the rate of cycles of oscillating drive 14. In continuous casting of metals, the stroke of oscillating drive 14 is typically in the range of 10 to 12 millimeters. However, test stand 10 is adaptable to measure essentially any stroke length feasibly produced by hydraulic oscillator cylinder 12. The stroke length of pistons 90 and 98 within respective cylinders 88 and 96 allows for a range of stroke length of oscillating drive 14. This range may be increased or decreased with varying size shock absorbers 84 and 86. In addition, a change in the stroke length of oscillating drive 14 can be accommodated by moving first projection 21 along base 16 in the direction of arrow A, as seen in FIG. 2 and providing different length guide shafts 54. The adjustment of second projection 23 along the direction of arrow A also accommodates different length shock absorbers 84 and 86 as needed. In combination with the adjustment of the stroke length of oscillating drive 14, the rate of oscillation can be controlled as well, as noted above. Typically for use with continuous casting of metal, the rate of oscillation ranges from approximately 2.5 to 6 hertz, although this range can be greatly varied without departing from the spirit of the invention.

As previously noted, computer 4 (FIG. 1) preferably controls operation of oscillator cylinder 12 so that very accurate measurements can be made as oscillator cylinder 12 is being tested on test stand 10. In particular, computer 4 sends a command signal via command line 6 to servo 5 in order to oscillate oscillating drive 14. In this capacity, computer 4 acts a control device to input requested motion to the oscillating drive. Thus, computer 4 provides a command or desired stroke length and a command or desired oscillation rate of oscillating drive 14 whereby a command position of oscillating drive 14 is determined. In addition, computer 4 receives feedback from position sensor 7 via feedback line 8. In particular, position sensor 7 senses an actual cylinder position and actual motion of oscillating drive 14. Computer 4 is programmed with a comparison circuit for comparing the requested motion with the actual motion and the command position with the actual position. Comparison of the command position with the actual position allows charting of a position error between the two, as indicated in the graph of FIG. 13. The graph of FIG. 13 or similar graphs are preferably displayed on a computer screen (represented by the graph of FIG. 13) of computer 4 whereby realtime feedback may be viewed and analyzed. The use of computer 4 allows for continual updating and alteration of the variables noted above, that is, pressure within cylinders 88 and 96 as well as the stroke length of oscillating drive 14 and the rate of oscillation of oscillating drive 14.

Test stand 10 thus provides a compact unit for simulating the actual operational load within hydraulic oscillator cylinder 12. Via a functionality assessment mechanism, which preferably includes computer 4, test stand 10 is able to test a variety of functions of oscillator cylinder 12. For instance, test stand 10 can test for leakage or bypass of hydraulic fluid around the piston within oscillator cylinder 12 which drives oscillating drive 14 while cylinder 12 is under simulated forces found in operational use. Further, computer 4 is programmed to compare command inputs with actual performance of the oscillator cylinder under simulated operational conditions. For example, test stand 10 can compare the desired or command position of oscillating drive 14 with the actual position, thereby determining the accuracy of hydraulic oscillator cylinder 12 in regard to stroke length while under simulated load conditions. Likewise, test stand 10 can compare the desired or command rate of oscillations with the actual oscillations in order to assess the accuracy thereof with regard to oscillator cylinder 12 while under simulated load conditions. Temperature in the manifold of oscillator cylinder 12 may also be measured, as well as the hydraulic fluid pressure during extension and retraction of oscillating drive 14. Using the information from these assessments, oscillator cylinder 12 may then be determined to be within acceptable standards or repaired if it is not.

While the exemplary embodiment shown in the drawings incorporates the use of a set of first shock absorbers 84 on one side of movable plate 38 and a set of second shock absorbers 86 on the other side of movable plate 38, test stand 10 can be modified to include only one or the other of shock absorbers 84 and 86 so that shock absorbers are positioned only on one side of movable plate 38. This configuration is appropriate for testing oscillator cylinder 12 operating under certain conditions. In addition, a single shock absorber may be disposed on one side of movable plate 38 instead of a plurality thereof. With the use of a single shock absorber on a given side, it is preferable for that shock absorber to be centrally located with respect to movable plate 38 and thus preferably aligned with central axis 52 thereof so as to aid in maintaining proper alignment of movable plate 38 and oscillating member 14.

It is noted that the oscillating drive may be directly contacted with the shock absorber instead of including the oscillating member and translating structure. However, doing so may cause unwanted wear of the oscillating drive. Thus, it is preferable to use an adapter of some sort, preferably threaded, to reduce or eliminate this problem. A gas-filled shock absorber may be modified to include such an adapter. For instance, the piston thereof may include a threaded or other adapter portion for connecting to the oscillating drive.

In addition, a gas-filled shock absorber may be modified to mount on a rigid structure other than that described above. Thus, for instance, a modified gas-filled shock absorber may be mounted to a rigid structure with bolts, clamps or any other suitable means. Such a modified shock absorber may include a mounting flange, for instance, welded or otherwise joined thereto or formed integrally therewith.

Where a rigid member analogous to projection 21 is used, it need not define a hole therein to receive translating structure such as translating structure 35. Alternately, for example, such a rigid member may define a slot open to its circumference or may comprise more than one member. For instance, a rigid member analogous to projection 21 may be replaced by a pair of rigid members spaced from one another to allow translating structure to extend there between. In addition, as implied regarding discussion of the mounting of gas-filled shock absorbers, such a rigid member need not define holes for receiving respective gas-filled shock absorbers therein although the configuration described with test stand 10 provides a very stable structure and facilitates proper alignment of the shock absorbers to facilitate accurate linear movement of the pistons thereof.

Where a pair of spaced rigid members are used, they need not include plates like plates 22 and 24 and need not have substantially flat, parallel surfaces facing one another, although such surfaces facilitate proper alignment and standardization of the gas-filled shock absorbers and guide shafts used therewith. In addition, such plates having standard thicknesses facilitate such standardization. Similarly, oscillating member 33 need not include a plate like plate 38 nor have substantially flat surfaces which are substantially parallel to one another. However, this configuration also facilitates proper alignment and standardization as noted above.

Whether gas-filled shock absorbers are used on one side only or on both sides of an oscillating member, guide members may or may not be used to guide the oscillating member although using guide members is preferred to enhance proper alignment and smooth movement of the oscillating member and may be required under certain circumstances. Where guide members are used, they may be of any appropriate configuration and need not extend through holes formed in the oscillating member. They may also, for instance, be disposed in slots which open toward the circumference of the oscillating member or may otherwise be disposed along the circumference of the oscillating member. In addition, guide members may be mounted by alternate configurations from that shown with test stand 10. However, the configuration shown provides a stable configuration and maintains a constant spacing between plates 22 and 24, which facilitates standardization and alignment, as discussed above.

It is noted that a position sensor such as sensor 7 is often built in to the oscillator cylinder, as shown in the exemplary embodiment. However, this is not always the case, and thus a position sensor may alternately be positioned on any of the members which oscillate. Most preferably, an alternate location would be on oscillating member 38 due to its having a suitable location with relatively easy access thereto. However, such a sensor may also be placed on translating structure 35 or oscillating drive 14 where the configuration of the test stand permits. Position sensor 7 may be any suitable sensor known in the art, such as a linear voltage displacement transducer (LVDT) or a digital sensor.

Other variations within obvious to one skilled in the art may be made within the scope of the present invention.

In addition, the inventors contemplate the use of test stand 10 with other types of oscillator cylinders.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method for testing an oscillator cylinder having an oscillating drive, the method comprising the steps of:

operating the oscillator cylinder with hydraulic fluid;

oscillating the oscillating drive;

reacting movement of the oscillating drive with at least one first gas-filled shock absorber comprising a cylinder and a piston one of which is stationary; and assessing the functionality of the oscillator cylinder including the step of assessing hydraulic fluid leakage within the oscillator cylinder.

2. The method of claim 1 wherein the step of oscillating comprises the step of oscillating the oscillating drive linearly solely along a first single axis; and the step of reacting comprises the step of reacting movement of the oscillating drive by relative linear sliding movement between the cylinder and piston solely along a second single axis parallel to the first axis.

3. The method of claim 1 further including the step of controlling base line gas pressure within the at least one gas-filled shock absorber.

4. A method for testing an oscillator cylinder having an oscillating drive, the method comprising the steps of:

oscillating the oscillating drive along a central longitudinal axis thereof;

reacting movement of the oscillating drive with at least one first gas-filled shock absorber comprising a cylinder and a piston one of which is stationary;

wherein the reacting step includes the step of reacting the movement of the oscillating drive with a plurality of the gas-filled shock absorbers evenly distributed about the axis; and assessing the functionality of the oscillator cylinder.

5. The method of claim 1 further including the step of oscillating an oscillating member with the oscillating drive; and wherein the reacting step includes the step of reacting the movement of the oscillating drive via the oscillating member.

6. A test stand for testing an oscillator cylinder having an oscillating drive, the test stand comprising:

an oscillating member adapted for mounting on the oscillating drive;

at least one first gas-filled shock absorber for reacting movement of the oscillating member;

at least one second gas-filled shock absorber for reacting movement of the oscillating member whereby the first and second shock absorbers are adapted to react movement of the oscillating drive;

wherein in response to oscillating movement of the oscillating member the at least one first shock absorber undergoes compression as the at least one second shock absorber undergoes decompression and vice versa; and an oscillator cylinder functionality assessment mechanism operationally connected to the oscillating member and adapted to assess the functionality of the oscillator cylinder.

7. The test stand of claim 6 further including a rigid frame on which the shock absorbers are mounted and which is adapted to mount the oscillator cylinder thereon.

8. The test stand of claim 7 wherein the at least one first gas-filled shock absorber counters movement of the oscillating member in a first direction and the at least one second gas-filled shock absorber counters movement of the oscillating member in a second direction opposite to the first direction.

9. The test stand of claim 8 wherein the oscillating member has first and second opposed sides; wherein the at least one first gas-filled shock absorber is disposed on the first side of the oscillating member and the at least one second gas-filled shock absorber is disposed on the second side of the oscillating member.

10. The test stand of claim 9 wherein there are a plurality of the first shock absorbers and a plurality of the second shock absorbers aligned respectively with the first shock absorbers.

11. The test stand of claim 9 wherein the frame includes a base and first and second projections mounted on the base and spaced from one another; wherein the first and second shock absorbers are mounted respectively on the first and second projections; and wherein the oscillating member is disposed between the projections.

12. The test stand of claim 11 wherein one projection defines an opening through which translating structure extends; and wherein the translating structure is connected to the oscillating member and adapted to connect to the oscillating drive.

13. The test stand of claim 11 wherein at least one guide member extends between the first and second projections for guiding movement of the oscillating member.

14. The test stand of claim 13 wherein at least one bushing is mounted on the oscillating member and movably engages the at least one guide member.

15. The test stand of claim 6 wherein the oscillating member has a central axis along which the oscillating member oscillates; and wherein the shock absorbers are spaced evenly about the axis.

16. The test stand of claim 6 wherein the oscillating member has a central axis along which the oscillating member oscillates; and wherein a plurality of guide members are spaced evenly about the axis for guiding movement of the oscillating member.

17. The test stand of claim 6 further including a pressure control mechanism for controlling base line gas pressure within the at least one gas-filled shock absorber.

18. The test stand of claim 6 wherein the assessment mechanism includes:

a control device adapted for inputting requested motion to the oscillating drive;

a sensor adapted for determining actual motion of the oscillating drive; and a comparison circuit for comparing the requested motion with the actual motion.

19. The test stand of claim 18 wherein a computer serves as the control device and includes the comparison circuit.

20. The test stand of claim 6 further comprising a rigid frame including a base and first and second spaced projections mounted on the base; and wherein:

the first and second projections have respective substantially flat surfaces which are substantially parallel to one another and face one another;

the opposed sides of the oscillating member are substantially flat and substantially parallel to one another and the substantially flat surfaces of the first and second projections; the oscillating member being oscillatably mounted on the frame between the flat surfaces of the first and second projections;

the at least one first shock absorber comprises a plurality of first gas-filled shock absorbers mounted on the first projection;

the at least one second shock absorber comprises a plurality of second gas-filled shock absorbers mounted on the second projection; and further comprising:

a plurality of guide members extending between the first and second projections for guiding movement of the oscillating member.

21. A method for testing an oscillator cylinder having an oscillating drive, the method comprising the steps of:

oscillating the oscillating drive;

reacting movement of the oscillating drive with at least one first gas-filled shock absorber; and assessing the functionality of the oscillator cylinder;

wherein the reacting step includes the step of countering movement of the oscillating drive with the at least one shock absorber to simulate operational conditions of the oscillator cylinder;

wherein the oscillating step includes the step of moving the oscillating drive in a first direction and in a second direction opposite to the first direction in alternating fashion; and wherein the step of countering includes the steps of countering the movement of the oscillating drive in the first direction with the at least one first gas-filled shock absorber and countering the movement of the oscillating drive in the second direction with at least one second gas-filled shock absorber;

wherein the step of countering the movement of the oscillating drive in the first direction includes the step of countering the first direction movement with a first force; and wherein the step of countering the movement of the oscillating drive in the second direction includes the step of countering the second direction movement with a second force which is different than the first force; and wherein the step of countering the first direction movement and the second direction movement includes the steps of setting base line gas pressure in the at least one first shock absorber at a first pressure and setting base line gas pressure in the at least one second shock absorber at a second pressure which is different than the first pressure.

22. The method of claim 21 wherein the reacting step includes reacting movement of the oscillating drive with the first and second gas-filled shock absorbers each having a piston and a cylinder.

23. A method for testing an oscillator cylinder having an oscillating drive, the method comprising the steps of:

oscillating the oscillating drive along a central longitudinal axis thereof;

reacting movement of the oscillating drive with at least one first gas-filled shock absorber comprising a cylinder and a piston one of which is stationary; wherein the reacting step includes the step of reacting the movement of the oscillating drive with a plurality of the gas-filled shock absorbers which are equidistant from the central axis; and assessing the functionality of the oscillator cylinder.

24. A method for testing an oscillator cylinder having an oscillating drive, the method comprising the steps of:

oscillating the oscillating drive to move the oscillating drive in a first direction and in a second direction opposite to the first direction in alternating fashion;

reacting movement of the oscillating drive with at least one first gas-filled shock absorber comprising a cylinder and a piston one of which is stationary; wherein the reacting step includes the step of countering movement of the oscillating drive with the at least one shock absorber to simulate operational conditions of the oscillator cylinder; and wherein the step of countering includes the steps of countering the movement of the oscillating drive in the first direction with the at least one first gas-filled shock absorber and countering the movement of the oscillating drive in the second direction with at least one second gas-filled shock absorber; and assessing the functionality of the oscillator cylinder.

25. The method of claim 24 wherein the step of countering the movement of the oscillating drive in the first direction includes the step of countering the first direction movement with a first force; and wherein the step of countering the movement of the oscillating drive in the second direction includes the step of countering the second direction movement with a second force which is different than the first force.

26. A method for testing an oscillator cylinder having an oscillating drive, the method comprising the steps of:

oscillating the oscillating drive;

oscillating an oscillating member with the oscillating drive;

reacting movement of the oscillating drive via the oscillating member with at least one first gas-filled shock absorber comprising a cylinder and a piston one of which is stationary; wherein the reacting step includes the step of countering movement of the oscillating member with the at least one first gas-filled shock absorber disposed on a first side of the oscillating member and at least one second gas-filled shock absorber disposed on a second side of the oscillating member opposed to the first side; and assessing the functionality of the oscillator cylinder.

27. The method of claim 5 further including the step of guiding the movement of the oscillating member with at least one stationary guide member via sliding engagement therebetween.

28. A method for testing an oscillator cylinder having an oscillating drive, the method comprising the steps of:

oscillating the oscillating drive;

reacting movement of the oscillating drive with at least one first gas-filled shock absorber comprising a cylinder and a piston one of which is stationary;

assessing the functionality of the oscillator cylinder;

controlling the movement of the oscillating drive with a computer; and comparing a command position and an actual position of the oscillating drive to establish a position error of the oscillating drive.

29. The method of claim 28 further including the step of operating the oscillating cylinder with hydraulic fluid; and wherein the assessing step includes the step of assessing hydraulic fluid leakage within the oscillator cylinder.

30. A test stand for testing an oscillator cylinder having an oscillating drive, the test stand comprising:

a stationary guide member;

an oscillating member oscillatingly mounted on and slidably engaging the guide member and adapted for mounting on the oscillating drive;

at least one gas-filled shock absorber for reacting movement of the oscillating member whereby the shock absorber is adapted to react movement of the oscillating drive;

an oscillator cylinder functionality assessment mechanism operationally connected to the oscillating member and adapted to assess the functionality of the oscillator cylinder; and wherein the oscillating member comprises a bushing slidably engaging the guide member.

31. The test stand of claim 30 wherein the guide member is part of a stationary frame; the at least one shock absorber comprises a cylinder and a piston slidably mounted thereon; and one of the piston and cylinder is rigidly mounted on the frame.

32. The test stand of claim 30 wherein the assessment mechanism includes:

a computer adapted for inputting requested motion to the oscillating drive;

a sensor adapted for determining actual motion of the oscillating drive; and a comparison circuit of the computer for comparing the requested motion with the actual motion.

33. A test stand for testing an oscillator cylinder having an oscillating drive, the test stand comprising:

a stationary guide member;

an oscillating member oscillatingly mounted on and slidably engaging the guide member and adapted for mounting on the oscillating drive;

at least one gas-filled shock absorber for reacting movement of the oscillating member whereby the shock absorber is adapted to react movement of the oscillating drive;

an oscillator cylinder functionality assessment mechanism operationally connected to the oscillating member and adapted to assess the functionality of the oscillator cylinder; and a hardened plate removably mounted on the oscillating member and abutting the at least one shock absorber for protecting the oscillating member from damage.

34. The method of claim 1 wherein the reacting step includes the step of countering movement of the oscillating drive with the at least one shock absorber to simulate operational conditions of the oscillator cylinder.

* * * * *